US005522240A

United States Patent [19]

Wall et al.

[11] Patent Number: 5,522,240

[45] Date of Patent: Jun. 4, 1996

[54] FURNITURE ELASTIC WEBBING AND METHOD

[75] Inventors: Cothran D. Wall, Brown Summit; Steven Y. Wall, Greensboro, both of N.C.

[73] Assignee: Matrex Furniture Components, Inc., Greensboro, N.C.

[21] Appl. No.: 290,615

[22] Filed: Aug. 15, 1994

[51] Int. Cl.[6] ..... D04B 23/12

[52] U.S. Cl. ..... 66/192; 66/195; 66/170

[58] Field of Search ..... 66/169 R, 170, 66/190, 192, 195, 196, 198, 202, 201; 428/230, 245, 253

[56] References Cited

U.S. PATENT DOCUMENTS

| | | | |
|---|---|---|---|
| 3,077,758 | 2/1963 | Siciliano | 66/192 |
| 3,552,154 | 1/1971 | Lesley | 66/192 |
| 4,009,597 | 3/1977 | Wall et al. | 66/193 |
| 4,248,064 | 2/1981 | Odham | 66/192 |
| 4,733,545 | 3/1988 | Weinle et al. | 66/193 |
| 4,818,316 | 4/1989 | Weinle et al. | 66/193 |
| 5,125,246 | 6/1992 | Shytles | 66/195 |
| 5,265,445 | 11/1993 | Shytles et al. | 66/192 |
| 5,393,596 | 2/1995 | Tornero et al. | 428/229 |

*Primary Examiner*—C. D. Crowder
*Assistant Examiner*—Larry Worrell, Jr.

[57] ABSTRACT

A furniture elastic webbing is provided for use on sofa frames or the like to support seat and back cushions. The elastic webbing has a unique structure which provides controlled longitudinal stretch to support heavy loads such as the body weight of several adults simultaneously. The elastic webbing is warp knit by conventional methods with an inlaid, strong, durable control yarn generally walewise along each elastomeric yarn therein.

12 Claims, 4 Drawing Sheets

FURNITURE ELASTIC WEBBING AND METHOD

BACKGROUND OF THE INVENTION

1. Field of the Invention

The invention herein pertains to furniture construction and particularly to elastic seat and back webbings which are attached to furniture frames for cushion support. The webbings provided are knit with an elastomeric yarn and include a control yarn which limits the elongation of the elastomeric yarn and webbing when they are subjected to high loads such as when the webbings are used as seat supports for a sofa that is occupied by several adults.

2. Background and Objective of the Invention

In recent years the furniture industry has increased its output of chairs, sofas and other structures manufactured without metal springs. In their place, various types of supports such as elastic fabric webbings and the like have been used with varying degrees of success. Conventional metal coil springs provide durable, comfortable seating but are expensive, heavy and difficult to repair and maintain. Various types of fabrics, including elastic fabrics and webbing have been substituted in certain furniture structures but have not always proved satisfactory for their intended purposes. Furniture webbings in the past that have provided sufficient stretch and elongation have often failed under maximum use conditions or high loads. Such elastic webbings which have provided the necessary load support have been uncomfortable for the user due to their "stiff" or rigid feel. Thus with the disadvantages and problems associated with prior art resilient cushion supports, the present invention was conceived and one of its objectives is to provide an improved elastic webbing for furniture frames or the like and a method of making the same.

It is yet another objective of the present invention to provide a furniture elastic webbing which will endure years of adverse use conditions while offering comfort and durability.

It is still another objective of the present invention to provide an elastic webbing which is warp knit with an elastomeric yarn and a control yarn which limits the elongation of the elastomeric yarn.

It is still another objective of the present invention to provide a furniture frame utilizing the elastic webbing described herein which is economical to assemble and easy to repair and maintain.

Various other objectives and advantages of the present invention will become apparent to those skilled in the art as a more detailed description is set forth below.

SUMMARY OF THE INVENTION

The aforesaid and other objectives are realized by providing a knit elastic webbing for furniture construction which includes a plurality of walewise parallel stitch loop chains which form successive courses with a plurality of knit-in elastomeric yarns. A pair of parallel filling yarns are positioned weftwise in the fabric and contain the elastomeric yarns therebetween. A walewise control yarn is knit into the fabric between the parallel elastomeric yarns along side each of the elastomeric yarns. The control yarn passes walewise along one side of the elastomeric yarn for a short distance (1–3 stitch loops) where it then crosses the elastomeric yarn and continues along the opposite side for the same distance or number of stitch loops. It again crosses the elastomeric yarn and so forth in alternating fashion along the entire length of the stitch loop chain. This crossing pattern of the control yarn is mirrored along adjacent elastomeric yarns to provide strength to the elastic webbing and for a limiting effect when the webbing is loaded or stretched. Thus an elastic webbing which, without the control yarn, may stretch for example to 200% of its original, relaxed length, with the control yarns added, may stretch only 80 to 120% of its relaxed length. This "control" stretch provides strength to the elastic webbing while giving the ultimate user comfort in seating without a "mushy" or "too soft" feel.

The elastic webbing of the invention can be attached to, for example, conventional wooden furniture sofa or chair frames to support usual covered polyurethane cushions thereon.

DESCRIPTION OF THE PREFERRED EMBODIMENTS

Figure 3:
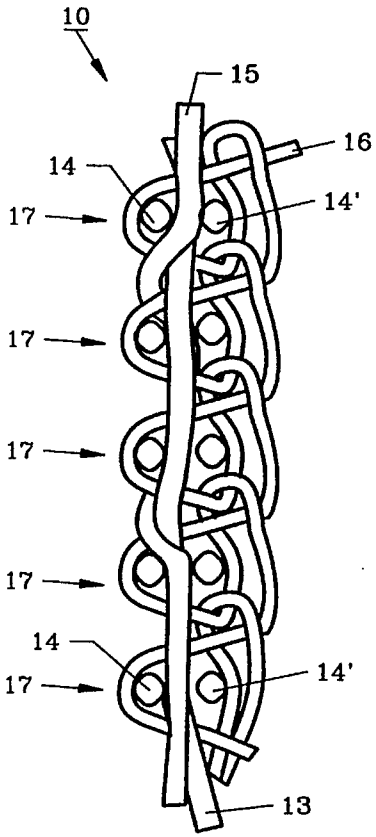
FIG. 3 shows a side view of the elastic webbing as seen in FIG. 2 along lines 3—3.
Figure 2:
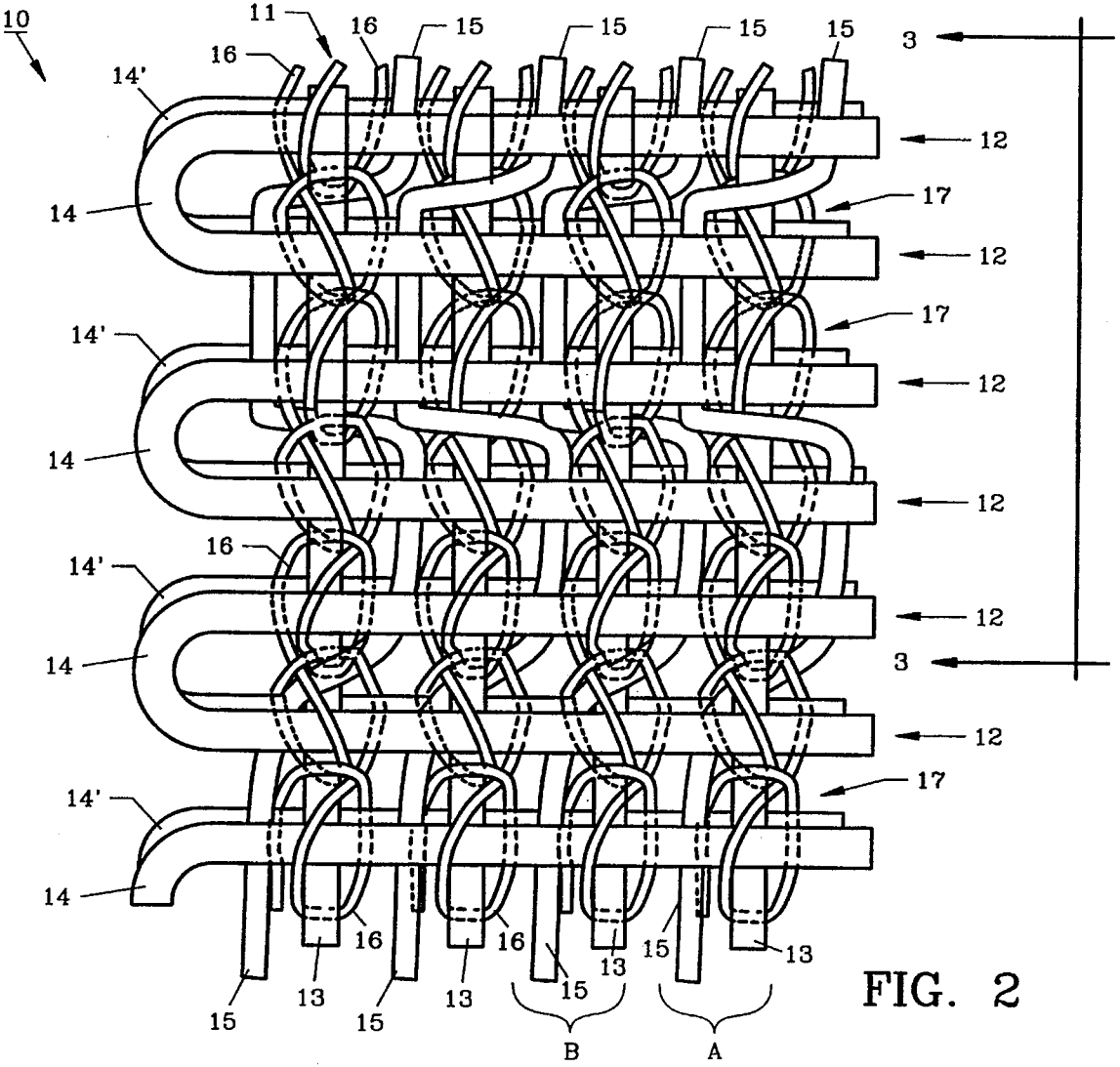
FIG. 2 demonstrates a close-up top view of a section of the elastic webbing as shown in FIG. 1 along lines 2—2.

The preferred form of the invention is illustrated in FIGS. 2 and 3 which show an elastic knit webbing for furniture which has a prefertable width of 7.6 cm and includes 38 ends of elastomeric yarn and 38 walewise parallel stitch loop chains. The webbing is formed on a conventional flatbed warp knitting machine such as a Comez in which a plurality of extruded rubber elastomeric yarns of 22 gauge are knit into walewise parallel stitch loop chains formed from 600 (2 ply×300) denier polyester yarn which form successive courses from side to side. A pair of parallel filling yarns are positioned weftwise in the elastic webbing and are held by the looped chains with the elastomeric yarns contained therebetween. The filling yarns preferrably consist of 1200 denier polypropylene yarn of the bulk continuous filament (bcf) type. A control yarn is likewise knitted into the elastic webbing and consists of a 1000 denier polypropylene yarn which is positioned walewise alongside the elastomeric yarn for 2 stitch loops where it then crosses the elastomeric yarn and continues alongside for 2 additional stitch loops, and so forth. Adjacent courses of elastomeric yarns demonstrate the control yarn passing across alternating top and bottom surfaces of the elastomeric yarns. As hereinbefore explained, the control yarns are positioned in the webbing to limit the amount of stretch or elongation of the elastomeric yarn in the walewise direction. The elastic knit webbing construction as shown herein will not substantially elongate in the weftwise direction.

The preferred use of the elastic webbing of the invention is for furniture construction and manufacture and is particularly useful for providing cushion supports to the back and seating areas of chairs, sofas or the like.

DETAILED DESCRIPTION OF THE DRAWINGS AND OPERATION OF THE INVENTION

Figure 1:
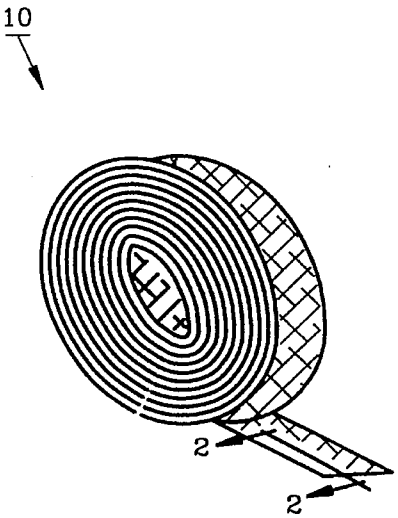
FIG. 1 illustrates a perspective view of a roll of elastic webbing of the invention which may be for example 30 meters in length and 7.6 cm in width.

Turning now to the drawings which are not represented in scale but to clearly show the various embodiments and constructions, FIG. 1 demonstrates a perspective view of a roll of elastic webbing 10 as may be sold to furniture manufacturers. Webbing 10 may be for example 7.6 cm wide and 30 meters in length although other widths and lengths could be manufactured and packaged as desired. Elastic webbing 10 is formed on a conventional warp knit machine such as a Comez as is standard and well known in the knitting industry.

In FIG. 2 an enlarged top plan view of a section of the fabric as shown in FIG. 1 along lines 2—2 is depicted which has been somewhat longitudinally stretched to better illustrate its construction. As seen, elastic webbing 10 includes a plurality of walewise parallel stitch loop chains shown generally at 11 which form successive courses 12 therealong utilizing loop stitch yarn 16. Walewise stitch loop chains 11 are preferrably formed from a 600 denier polyester (2 ply×300 d.). Elastomeric yarn 13 is inlaid in and walewise extends along said loop chains 11. Elastomeric yarn 13 may be an extruded rubber yarn of 22 gauge although other stretchable yarns of various gauges such as 28 or 34 gauge could also be employed, depending on the particular end use of elastic webbing 10. Filling yarn 14 may consist of a 1200 denier polypropylene yarn of the brief continuous filament type and as shown, a second parallel filling yarn 14' is seen beneath top filling yarn 14. As would be understood, elastic webbing 10 will stretch or elongate along its longitudinal axis (walewise) a controlled amount, for example up to 120% of its normal, relaxed length. Other elastomeric yarns having less elasticity and other knitting constructions can be employed which will further limit the walewise elongation as just described. As elastic webbing 10 is used in furniture structures, for example in seat webbing, it must carry a high load when used on sofa frames where 3 or more adults may sit simultaneously. Thus, to prevent undue elongation and to strengthen elastic webbing 10, control yarn 15 is employed which is knit between parallel filling yarns 14, 14' and between said filling yarns 14, 14'. Control yarn 15 may be for example a 1000 denier fibulated polypropylene yarn although other strong yarn types and sizes could be utilized, depending on the particular end use intended for elastic webbing 10.

As further shown in FIG. 2, control yarns 15 are knit beside elastomeric yarns 13 where they cross elastomeric yarns 13 every 2 walewise stitch loops 17. As elastic webbing 10 is stretched in a walewise direction, control yarns 15 become taut, until further stretching is not possible. Control yarns 15 alternate in passing along the top and bottom surfaces of adjacent elastomeric yarns 13 as seen in FIG. 2. From right to left in FIG. 2, as yarn control 15 passes across the bottom surface of elastomeric yarn 13 in wale A, it passes across the upper surface of elastomeric yarn 13 in wale B and so forth in alternating fashion throughout elastic webbing 10.

FIG. 3 illustrates a side view of webbing 10 as shown in FIG. 2 along lines 3—3 and likewise showns the placement of control yarn 15 along with loop stitch yarn 16 which may comprise a 600 denier polyester yarn.

Figure 5:
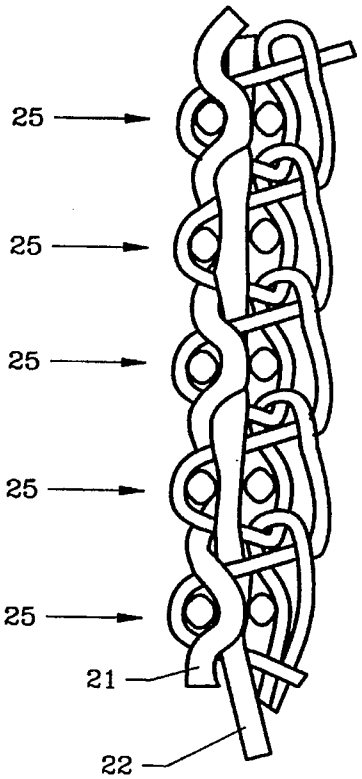
FIG. 5 pictures a side view of the elastic webbing as shown in FIG. 4 along lines 5—5.
Figure 4:
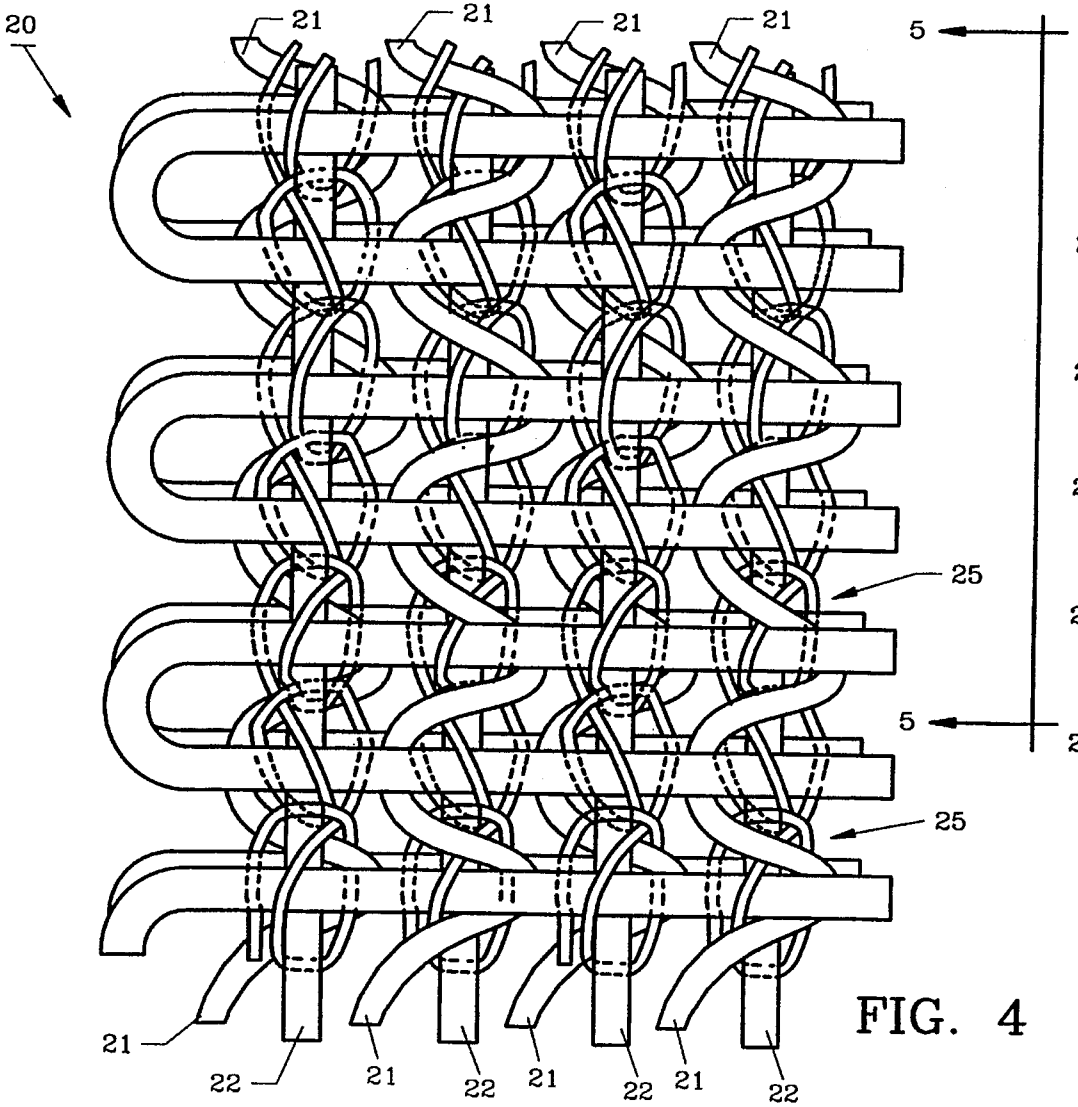
FIG. 4 depicts a top view of yet another embodiment of the elastic webbing as shown in FIG. 2.

In FIG. 4, a second webbing embodiment is seen whereby warp knit elastic webbing 20 is featured which is similar to elastic webbing 10 except that control yarn 21 crosses elastomeric yarn 22 at every stitch loop 25. As would be understood, elastic webbing 20 would have less longitudinal stretch than elastic webbing 10 with all other factors constant as control yarn 21 would extend less and therefore provide less longitudinal stretch to elastic webbing 21. In FIG. 5, a side view of elastic webbing 20 is shown with control yarn 21 crossing at every loop stitch.

Figure 7:
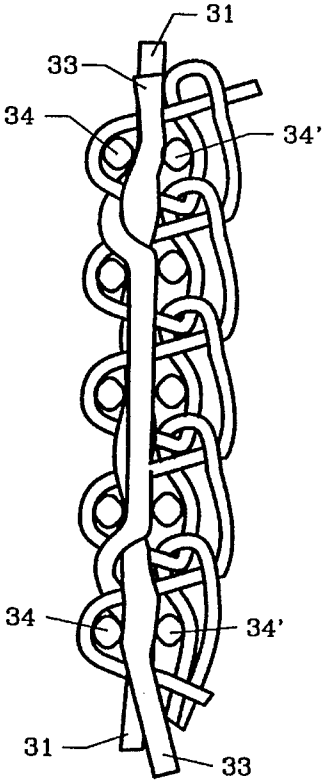
FIG. 7 illustrates a side view of the elastic webbing as seen in FIG. 6 along lines 7—7.
Figure 6:
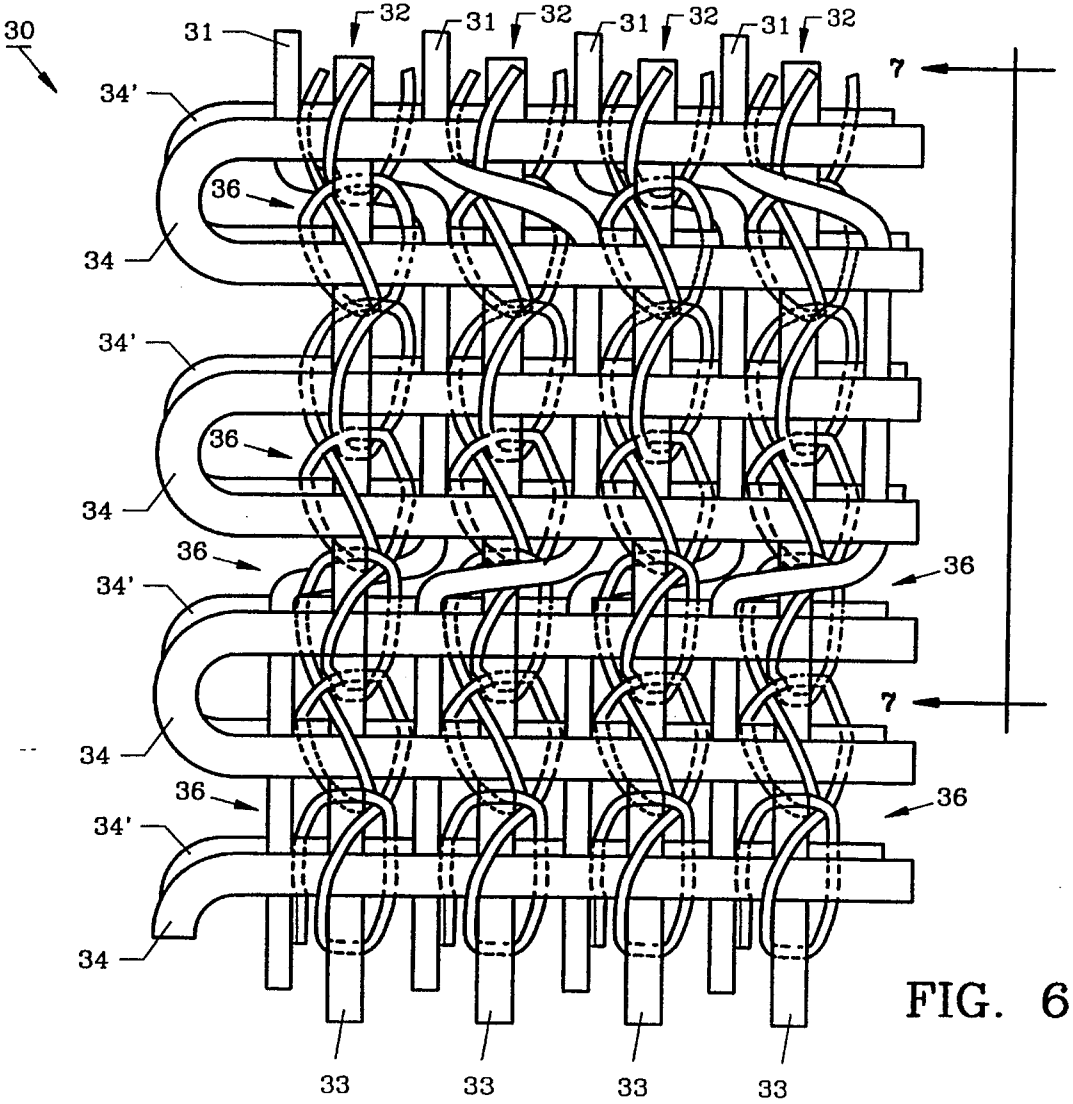
FIG. 6 shows a top view of a third embodiment of the webbing as shown in FIG. 2.

FIGS. 6 and 7 illustrate yet another embodiment with elastic webbing 30. Control yarn 31 in FIG. 6 crosses walewise parallel stitch loop chains 32 every 3 loop stitches 36. As further seen, control yarn 32 is knit into elastic webbing 30 between filling yarns 34, and 34'. FIG. 7 depicts a side view of one elastomeric yarn 33 to illustrate control yarn 32 crossing thereover.

Figure 8:
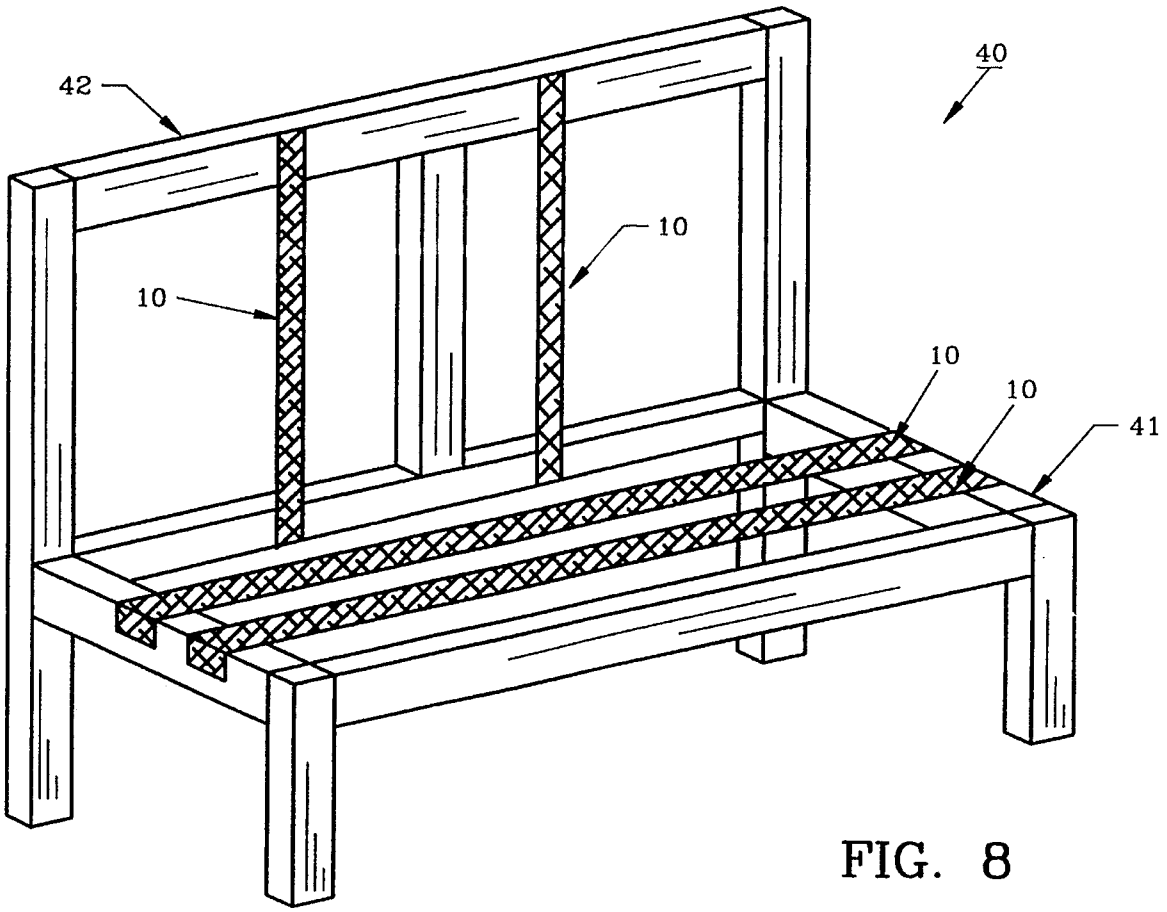
FIG. 8 demonstrates a conventional furniture frame having the elastic webbing of FIG. 1 mounted in place thereon for cushion support.

In FIG. 8 conventional wooden sofa frame 40 is pictured with elastic webbing 10 stapled thereto. As would be understood, elastic webbing 10 can be placed longitudinally on seat frame 41 or back frame 42 of sofa frame 40 or can be placed laterally thereacross. Elastic webbing 10 was selected for its particular stretch and durability based on the seat opening and strength of webbing required.

The illustrations, examples and embodiments provided herein are for explanatory purposes and are not intended to limit the scope of the appended claims. Modifications can be made to the elastic webbing as are known in the art such as providing a ravel resistant edge or by using other yarn sizes and types or other stitch patterns for particular purposes.

I claim:

1. A longitudinally stretchable warp knit fabric comprising:

(a) a plurality of walewise parallel stitch loop chains forming successive courses extending from side to side, (b) an elastomeric yarn inlaid in and extending along one of said loop chains, (c) a pair of filling yarns extending back and forth across said fabric and held by said loop chains, and (d) a control yarn knit walewise wholly inside the fabric plane through the loop chain between the pair of filling yarns to control the longitudinal stretch of said fabric.

2. The fabric of claim 1 wherein said loop chains are formed from a polyester yarn.

3. The fabric of claim 1 wherein said filling yarns are polypropylene yarn.

4. The fabric of claim 1 wherein said control yarn is a polypropylene yarn.

5. The fabric of claim 1 wherein said elastomeric yarn is a rubber yarn.

6. The warp knit fabric of claim 1 wherein said filling yarn comprises a pair of parallel filling yarns, said control yarn crossing over said elastomeric yarn and between said pair of filling yarns.

7. The warp knit fabric of claim 6 wherein said control yarn crosses over said elastomeric yarn at every stitch loop.

8. The warp knit fabric of claim 6 wherein said control yarn crosses over said elastomeric yarn at every third stitch loop.

9. A longitudinally stretchable warp knit fabric comprising:

(a) a plurality of walewise parallel stitch loop chains forming successive courses extending from side to side;

(b) elastomeric yarns inlaid in and extending along said loop chains;

(c) a pair of parallel filling yarns extending back and forth across said fabric and held by said loop chains, and (d) a plurality of control yarns, said control yarns knit walewise wholly inside the fabric plane through said loop chains between said parallel filling yarns and crossing said elastomeric yarns to control the longitudinal movement of said fabric.

10. The warp knit fabric of claim 9 wherein said control yarns cross said elastomeric yarns every two stitch loops.

11. The warp knit fabric of claim 9 wherein said elastomeric yarns comprises extruded rubber yarns.

12. The warp knit fabric of claim 6 wherein said control yarn crosses over said elastomeric yarn at every other stitch loop.

* * * * *